United States Patent [19]

Rousseau

[11] Patent Number: 4,534,528

[45] Date of Patent: Aug. 13, 1985

[54] PAINT CAN HOLDER

[76] Inventor: Michel Rousseau, 795, Place Matte, Saint-Tite, Canada, G0X 3H0

[21] Appl. No.: 574,529

[22] Filed: Jan. 27, 1984

[51] Int. Cl.[3] ..... E06C 7/14

[52] U.S. Cl. ..... 248/210

[58] Field of Search ..... 248/210, 311.2, 130, 248/131, 137, 138

[56] References Cited

U.S. PATENT DOCUMENTS

| | | | |
|---|---|---|---|
| 392,105 | 10/1888 | Chapman | 248/138 |
| 1,607,306 | 11/1926 | Rieff | 248/137 |
| 2,508,258 | 5/1950 | Heinrich . | |
| 2,895,700 | 7/1959 | Johnson | 248/210 |
| 2,952,434 | 9/1960 | Blanchard | 248/137 |
| 3,125,317 | 3/1964 | Law . | |
| 3,895,772 | 7/1975 | Ellingson . | |

FOREIGN PATENT DOCUMENTS

| | | | |
|---|---|---|---|
| 400177 | 8/1924 | Fed. Rep. of Germany | 248/210 |
| 1544265 | 4/1979 | United Kingdom | 248/210 |

*Primary Examiner*—Reinaldo P. Machado
*Assistant Examiner*—Alvin Chin-Shue

[57] ABSTRACT

A device to pivotally support a paint can, the device is adapted to be installed exteriorly of a ladder on either side rails and permits the paint can to remain in a level position independently of the angle of the ladder. The paint can is pivotally supported on a pair of spaced apart brackets seating the can handle anchoring supports.

2 Claims, 7 Drawing Figures

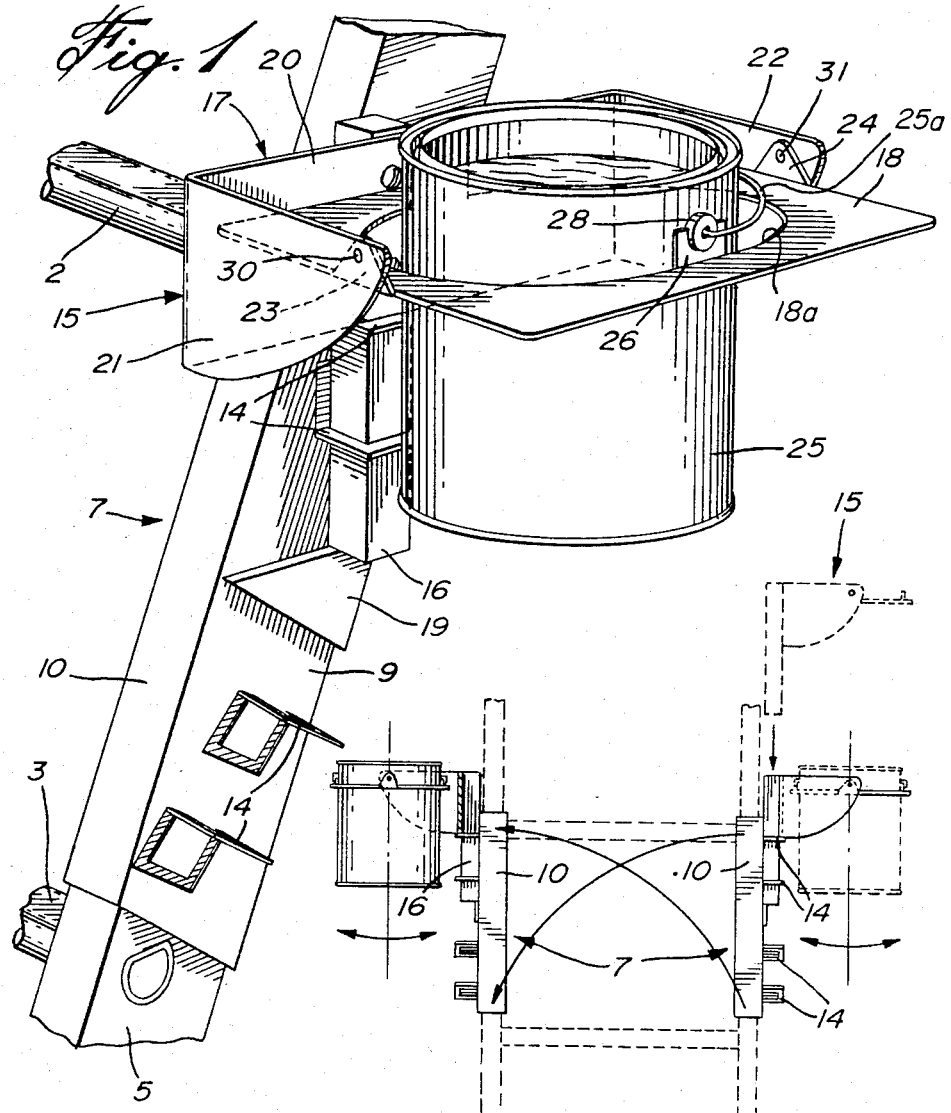
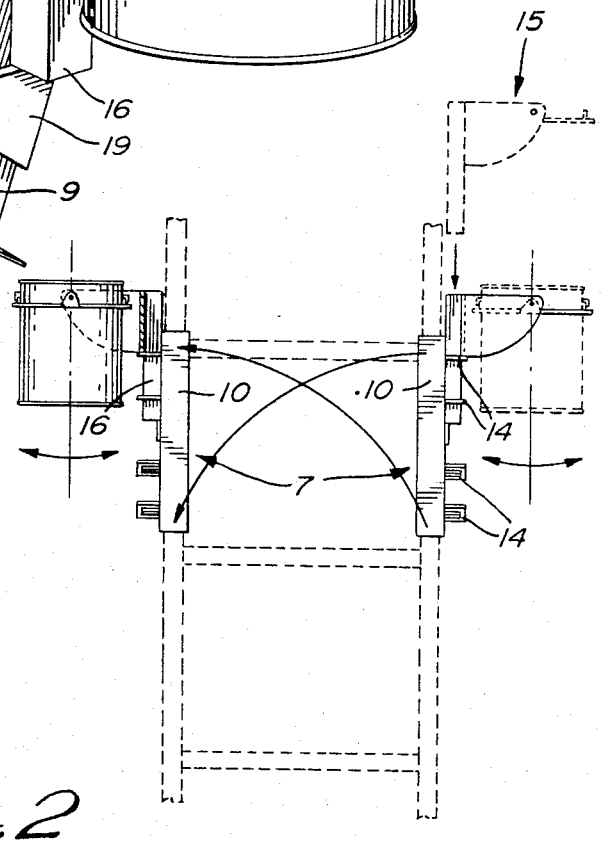
Fig. 2

PAINT CAN HOLDER

FIELD OF THE INVENTION

The invention relates to a paint can support hung to a ladder.

DESCRIPTION OF PRIOR ART

When a ladder is used to paint a wall, the paint can is often suspended to a rung by means of a "S"-shaped hook; in such an installation, the rung is obstructing the paint can opening.

In a number of paint can holders, it is necessary to remove the can handle because the holding device is using the same anchoring points as the handle; such a system is disadvantageous because the handle has to be reinstalled on the paint can after the use of the paint can holder.

OBJECTS OF THE INVENTION

It is therefore a first object of the invention to provide a paint can holder which will be arranged to pivotally support a paint can in such a way that it will keep its handle.

It is a second object of the invention to provide a device that is rapidly installed on either side of the ladder.

It is a further object of the invention to provide a device which allows the paint can to pivot about both axes of the horizontal plan to remain in a level position independently of the angle of the ladder in any direction.

SUMMARY OF THE INVENTION

In accordance with the invention, a hook member is adapted to be installed on a ladder having a plurality of rungs between side rails, the hook member comprises an interior flange, an exterior flange, both adapted to extend respectively on either side of one of the side rails and a transverse web joining laterally the interior and exterior flanges, the interior flange is adapted to engage one of the rungs, the invention further comprising a can supporting plate horizontally carried by and laterally extending from said exterior flange and which comprises an elongated aperture of a length substantially larger than and of a width just larger than the cross-sectional size of the can, a pair of spaced-apart brackets upstanding from and respectively secured to the plate on each side and centrally of the aperture, the brackets have notches adapted to pivotally receive the round, protruding handle-anchoring supports of the can. These bracket notches are transversely oriented relative to the plate and aligned about a first pivot axis transverse to the plane of the interior and exterior flanges, the aperture is receiving the can to a level where the handle anchoring supports seat in the bracket notches whereby the can may pivot on the brackets about the anchoring supports with the can handle resting on said plate.

Preferably, the plate is pivotally carried by said exterior flange for rotation about a second pivot axis transverse to said first pivot axis.

BRIEF DESCRIPTION OF THE DRAWINGS

FIG. 1 is a perspective view of the invention supporting the paint can on the right side of the ladder;

FIG. 2 is a front view of the invention showing how the hook member is turned upside down to install the paint can holder on either side of the ladder;

As shown in FIGS. 1 and 3, the paint can holder 6 is fitted to a ladder 1 having a plurality of rungs such as 2 and 3, between side rails 4 and 5.

Figure 3:
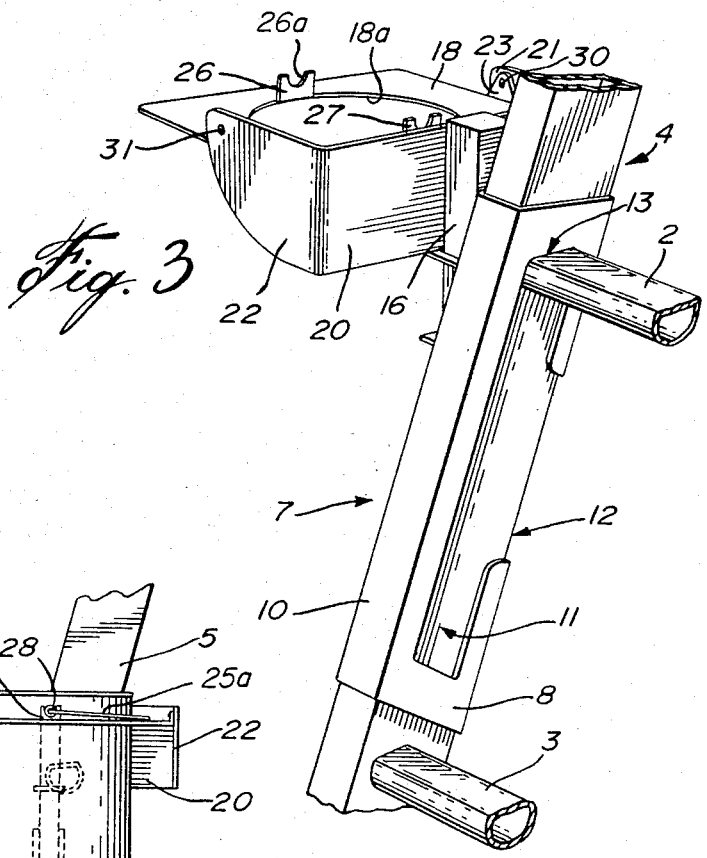
FIG. 3 is a fragmentary perspective view of the left side of a ladder showing the installation of the hook member.
Figure 4:
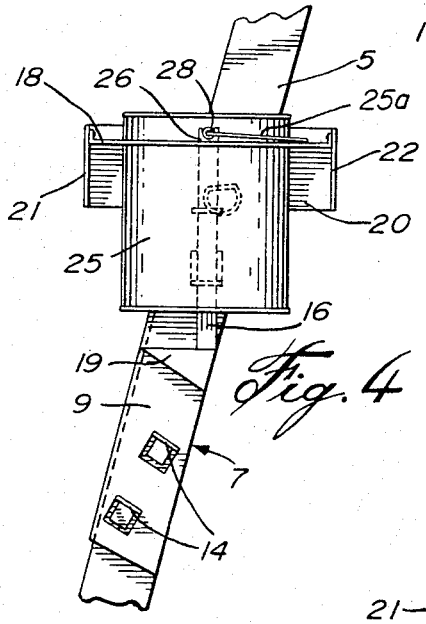
FIG. 4 is a side view of the invention with the ladder in nearly vertical position.
Figure 5:
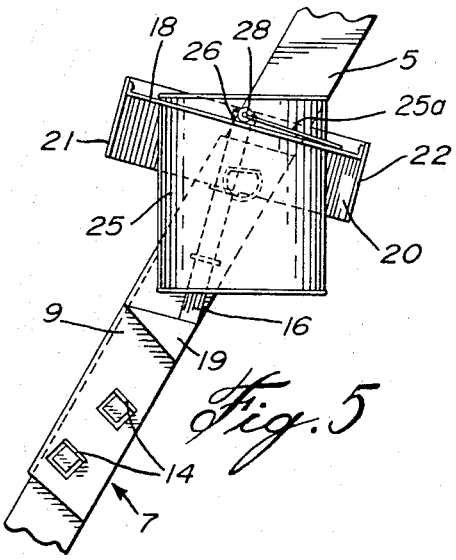
FIG. 5 is a side view of the invention such as in FIG. 4 showing how the paint can is pivoting when the ladder is inclined.
Figure 6:
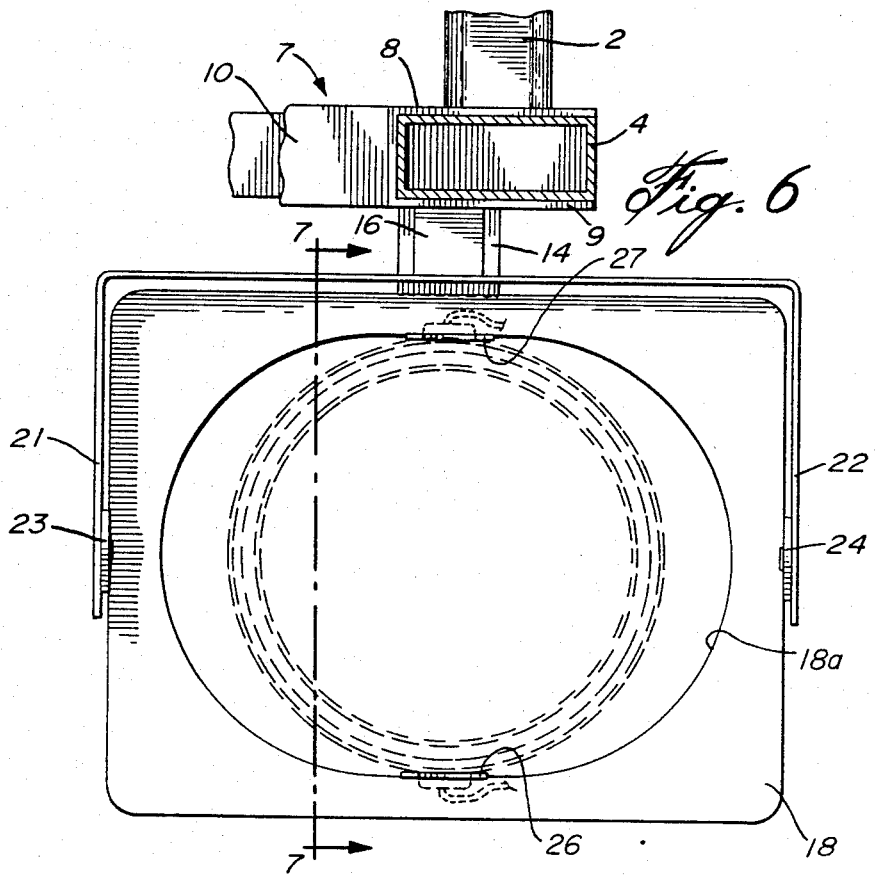
FIG. 6 is a top plan view of the invention showing the shape of the aperture in the can supporting plate.
Figure 7:
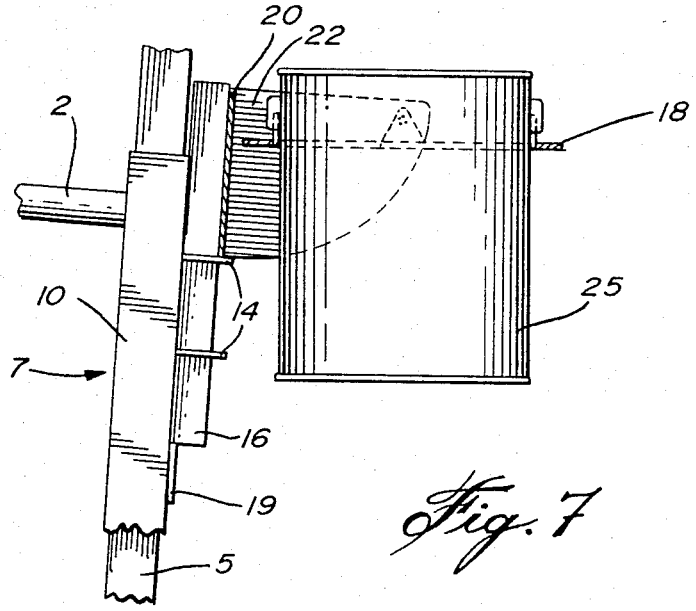
FIG. 7 is a sectional view of the invention taken on line 7—7 of FIG. 6.

The paint can holder comprises a hook member 7 formed of an interior flange 8, an exterior flange 9 and a transverse web 10 joining laterally the two parallel flanges 8 and 9. The hook member 7 is installed over one of the side rails 4 or 5 and is engaging with a rung such as 2 to remain at the desired level.

The rung 2 is introduced in the longitudinal slot 11, as seen in FIG. 3, through the central opening 12. To lock the hook member 7 in position, it must be lowered until the rung 2 abuts at the upper end 13 of the slot 11.

The upper and lower halves of the hook member 7 are identical to permit its installation on either side of ladder 1 as illustrated in FIG. 2.

The exterior flange 9 comprises two pairs of aligned brackets 14 respectively secured on the upper and lower halves of the hook member 7 to secure the paint can supporting section 15. Only one pair of brackets is used depending on which side of the ladder 1 the hook member 7 is installed. The pairs of brackets 14 are oppositely inclined relative to the longitudinal axis of hook member.

The paint can supporting section 15 comprises a post 16, a U-shaped member 17 and a paint can supporting plate 18; the post 16 is inserted in the aligned brackets 14 and abuts a stopping plate 19 fixed to exterior flange 9. Post 16 is secured at its upper end to the center section 20 of U-shaped member 17 which further includes two transverse arms 21 and 22.

The paint can supporting plate 18 is pivotally mounted in between the transverse arms 21 and 22 by means of a pair of upwardly extending triangular brackets 23 and 24 secured on each side of the paint can supporting plate 18 and a pair of aligned pivots 30 and 31 extending respectively in between the triangular brackets 23 and 24 and the transverse arms 21 and 22. The paint can supporting plate 18 also comprises an elongated aperture of substantially oval shape in which is pivotally supported a paint can 25 on a pair of brackets 26 and 27 seating the handle anchoring supports 28 and 29. Can 25 is conventional, cylindrical and of the type provided with a wire handle 25*a* pivoted in supports 28 and 29, which are diametrically opposed, rounded and laterally protruding from the can 25 adjacent the top open end thereof. Brackets 26, 27 have a semi-circular notch 26*a* at their top edge for receiving supports 28, 29. These brackets 26, 27 are secured to and upstand from plate 18 contiguous to aperture 18, at its mid-length and aligned across the width of aperture 18*a*. Said width is such to provide a close enough fit for the can 25, so that supports 28, 29 will remain engaged with bracket notches 26*a*. The length of aperture 18*a* is sufficient to permit limited swinging of the paint can 25 about supports 28, 29, yet handle 25*a* can rest on plate 18.

The supporting system is advantageous over the prior art because there is no need to remove the handle of the paint can 25 to install it on the paint can supporting plate 18 and because the handle 25*a* is readily accessible for removing the paint can 25 from the support.

The paint can 25 is pivoted about an exis parallel to the rungs 2 and 3 while the paint can supporting plate 18 is pivoted about an axis transverse to the pivot axis of the paint can 25; such an arrangement permits the paint can to remain in a level position independently of the angle of the ladder 1 in any directions.

What I claim is:

1. A device for supporting a cylindrical can on a ladder having a plurality of rungs between side rails, said can being of the type having a handle and a pair of rounded, diametrically-disposed handle-anchoring supports laterally protruding from said can near the top open end thereof, said device comprising a hook member adapted to be installed over a portion of one of said side rails, said hook member comprising an interior flange and an exterior flange adapted to extend respectively on either side of one of said side rails, and a transverse web joining laterally said interior and exterior flanges, a hook-shaped slot formed in said interior flange and adapted to engage one of said rungs, a can-supporting plate, support means carried by, and protruding from, said exterior flange and supporting said plate in a generally horizontal position when said hook member is installed on one of said rails, said can-supporting plate having an elongated aperture, of a length longer than the diameter of said can and of a width to have a close fit with one such can inserted through said aperture, a pair of spaced brackets upstanding from and respectively secured to said plate on each side of and contiguous to said aperture, each bracket having a semicircular notch at its top edge, said notches being joined by a straight line transverse to the mid-length of said elongated aperture and normal to said exterior flange, said aperture adapted to receive said can to a level where said handle-anchoring supports seat in said notches and said handle rests on said plate, whereby said can may automatically pivot under gravity in said notches about said handle-anchoring supports to stay level despite varying ladder inclinations in a plane transverse to the plane containing said rails.

2. A device according to claim 1, wherein said support means comprises a post having its lower end removably secured to said exterior flange of said hook member and a U-shaped member formed of a pair of transverse arms and of a center section, said transverse arms respectively extending along each end of said elongated can-supporting plate, said center section fixed to the upper end of said post and aligned pivots pivotally connecting the center of the ends of said plate to said transverse arms, the line joining said pivots being normal to the line joining said bracket notches.

* * * * *